US006551123B1

(12) United States Patent
Schaeffeler et al.

(10) Patent No.: US 6,551,123 B1
(45) Date of Patent: Apr. 22, 2003

(54) GUIDING ARRANGEMENT FOR A PLUG-IN BATTERY PACK OPERATING AN ELECTRIC APPLIANCE

(75) Inventors: Alois Schaeffeler, Spaichingen (DE); Peter Broghammer, Wurmlingen (DE)

(73) Assignee: Marquardt GmbH, Rietheim-Weilheim (DE)

( * ) Notice: Subject to any disclaimer, the term of this patent is extended or adjusted under 35 U.S.C. 154(b) by 891 days.

(21) Appl. No.: 09/097,655

(22) Filed: Jun. 16, 1998

Related U.S. Application Data

(63) Continuation-in-part of application No. 08/599,070, filed on Feb. 9, 1996, now abandoned.

(30) Foreign Application Priority Data

Feb. 10, 1995 (DE) ..... 195 04 341

(51) Int. Cl.[7] ..... H01R 13/64
(52) U.S. Cl. ..... 439/374; 439/500; 439/680
(58) Field of Search ..... 439/500, 680, 439/374

(56) References Cited

U.S. PATENT DOCUMENTS

| | | | | |
|---|---|---|---|---|
| 3,883,789 A | | 5/1975 | Achenbach et al. | |
| 4,835,410 A | * | 5/1989 | Bhagwat et al. | 439/500 |
| 4,871,629 A | | 10/1989 | Bunyea | |
| 4,900,261 A | * | 2/1990 | Gentry et al. | 439/680 |
| 5,289,047 A | | 2/1994 | Broghammer | |
| 5,443,401 A | * | 8/1995 | Champion et al. | 439/680 |
| 5,520,555 A | * | 5/1996 | Taylor | 439/680 |

FOREIGN PATENT DOCUMENTS

| | | | | |
|---|---|---|---|---|
| DE | 31 21 883 | | 1/1983 | |
| DE | 8525 951.9 | | 2/1986 | |
| DE | 8620 387.8 | | 11/1986 | |
| DE | 8605 994.7 | | 8/1987 | |
| DE | 39 02 442 | | 8/1989 | |
| DE | 8434 232.3 | | 12/1989 | |
| DE | 40 38 785 | | 6/1992 | |
| DE | 41 14 854 | | 11/1992 | |
| DE | 43 40 232 | | 5/1994 | |
| DE | 44 04 036 | | 9/1994 | |
| DE | 43 17 002 | | 11/1994 | |
| EP | 0 630 078 | | 12/1994 | |
| GB | 2225178 | * | 5/1990 | 439/500 |
| WO | 92/05919 | | 4/1992 | |

* cited by examiner

*Primary Examiner*—Gary Paumen
(74) *Attorney, Agent, or Firm*—Robert Kinberg; Catherine M. Voorhees; Venable, LLP

(57) ABSTRACT

An electric appliance unit includes an appliance and a plug-in battery pack. The appliance has an appliance housing carrying an electric switch accommodated in a switch housing and including first electric contacts. The battery pack includes second electric contacts for engaging the first electric contacts. A first guiding arrangement guides and preliminarily centers the battery pack relative to the switch housing along a first insertion path extending to a first position to effect a coarse alignment of the first and second electric contacts upon reaching the first position. The first guiding arrangement includes a first guide component carried by the battery pack and cooperating, along the first insertion path, with a second guide component in the appliance housing. A second guiding arrangement guides and finely centers the battery pack relative to the switch housing along a second insertion path extending from the first position to a second position to effect a precise alignment of the first and second electric contacts with one another along the second insertion path. The second guiding arrangement includes a third guide component carried by the battery pack and cooperating, along the second insertion path, with a fourth guide component on the switch housing.

15 Claims, 5 Drawing Sheets

GUIDING ARRANGEMENT FOR A PLUG-IN BATTERY PACK OPERATING AN ELECTRIC APPLIANCE

CROSS-REFERENCE TO RELATED APPLICATION

This application is a continuation-in-part of application Ser. No. 08/599,070 filed Feb. 9, 1996 now abandoned.

BACKGROUND OF THE INVENTION

Electric appliances, such as electric tools operated independently of the mains, for example, battery-operated screwdrivers, battery-operated drills or the like, can be driven by means of a plug-in, rechargeable battery pack which is connected by an electric switch to the electric motor of the tool.

An electric switch for use with a battery-operated electric tool is disclosed, for example, in U.S. Pat. No. 5,289,047. The switch has a housing on which, on the one hand, contacts in the form of contact clips are arranged for a pluggable electrical connection with mating contacts on the battery pack and on which, on the other hand, terminals are arranged for electrical connection to the electric motor. It has been found that damage can occur to the contact clips on the switch housing when the battery pack is being plugged into the electric tool.

SUMMARY OF THE INVENTION

It is an object of the invention to provide an improved electric appliance unit such as an electric tool, in which the contacts located in the tool housing are protected against damage when the battery pack is plugged in.

This object and others to become apparent as the specification progresses, are accomplished by the invention, according to which, briefly stated, the electric appliance unit includes an appliance and a plug-in battery pack. The appliance has an appliance housing carrying an electric switch accommodated in a switch housing and including first electric contacts. The battery pack includes second electric contacts for engaging the first electric contacts. The battery pack has consecutive first and second positions upon introduction thereof into the appliance. In the first position the first and second electric contacts initially touch one another and in the second position the first and second electric contacts are in a final operative engagement. A first guiding arrangement guides and preliminarily centers the battery pack relative to the switch housing along a first insertion path extending to the first position to effect a coarse alignment of the first and second electric contacts upon reaching the first position. The first guiding arrangement includes a first guide component carried by the battery pack and cooperating, along the first insertion path, with a second guide component carried by the appliance housing. A second guiding arrangement guides and finely centers the battery pack relative to the switch housing along a second insertion path extending from the first position to the second position to effect a precise alignment of the first and second electric contacts with one another along the second insertion path. The second guiding arrangement includes a third guide component carried by the battery pack and cooperating, along the second insertion path, with a fourth guide component on the switch housing.

The guide components of the second guiding means on the switch housing and on the battery pack may be designed as projections (shoulders) which are at least as long as the associated contacts or mating contacts. The result is a reliable guidance when the battery pack is plugged in even before the contacts touch the mating contacts. The shoulders may have planar faces for the purpose of improving the guidance further. It is preferable to use a plurality of faces to form a shoulder, so that the shoulder on the battery pack is configured as a receptacle and the shoulder on the switch housing is designed as a plug-in guide. The plug-in guide can then be designed as an approximately cuboidal part closed at the side, or as an approximately U-shaped part partly open at the side.

As a rule, the switch housing is plastic and is produced as an injection-molded part. It is feasible to make one component of the second guiding means from the same material, integrally with the switch housing. In addition, a stop surface can be arranged between the components of the second guiding means on the battery pack and the switch housing, for example, for limiting the plug-in movement for protecting the contacts or for holding the switch in the tool housing. Furthermore, the component of the second centering and/or guiding means on the switch housing may be configured such that the battery pack can be introduced only in a specific position, thereby providing protection against polarity reversal of the battery pack. For this purpose, the component of the second guiding means on the switch housing may be provided with a slot or a key which engages in a corresponding counterpart of the component of the second guiding means on the battery pack.

It is a particular advantage of the invention that guidance of the battery pack is achieved when it is being plugged into the electric tool. This guidance effects a preliminary (coarse) centering of the battery pack until the electric contacts of the battery pack initially touch the electric contacts of the switch, and thereafter the guidance effects a subsequent fine centering for the final engagement of the electric contacts. As a result of this arrangement a tilting of the battery pack during its introduction into the tool is prevented. Protection against bending of the contacts when the battery pack is plugged in is thereby achieved, and thus the service life of the contacts is extended. Also, the contacts are subjected to less stress. Consequently, it is possible to use a less expensive material for the contacts, whereby cost advantages can be achieved. The shoulder (projection) on the switch housing also provides further protection for the contacts, thus preventing them from being bent during transport or assembly of the switch. This contributes to the reduction of waste.

Exemplary embodiments of the invention are shown in the drawings and will be described in more detail below.

DESCRIPTION OF THE PREFERRED EMBODIMENTS

Figure 1:
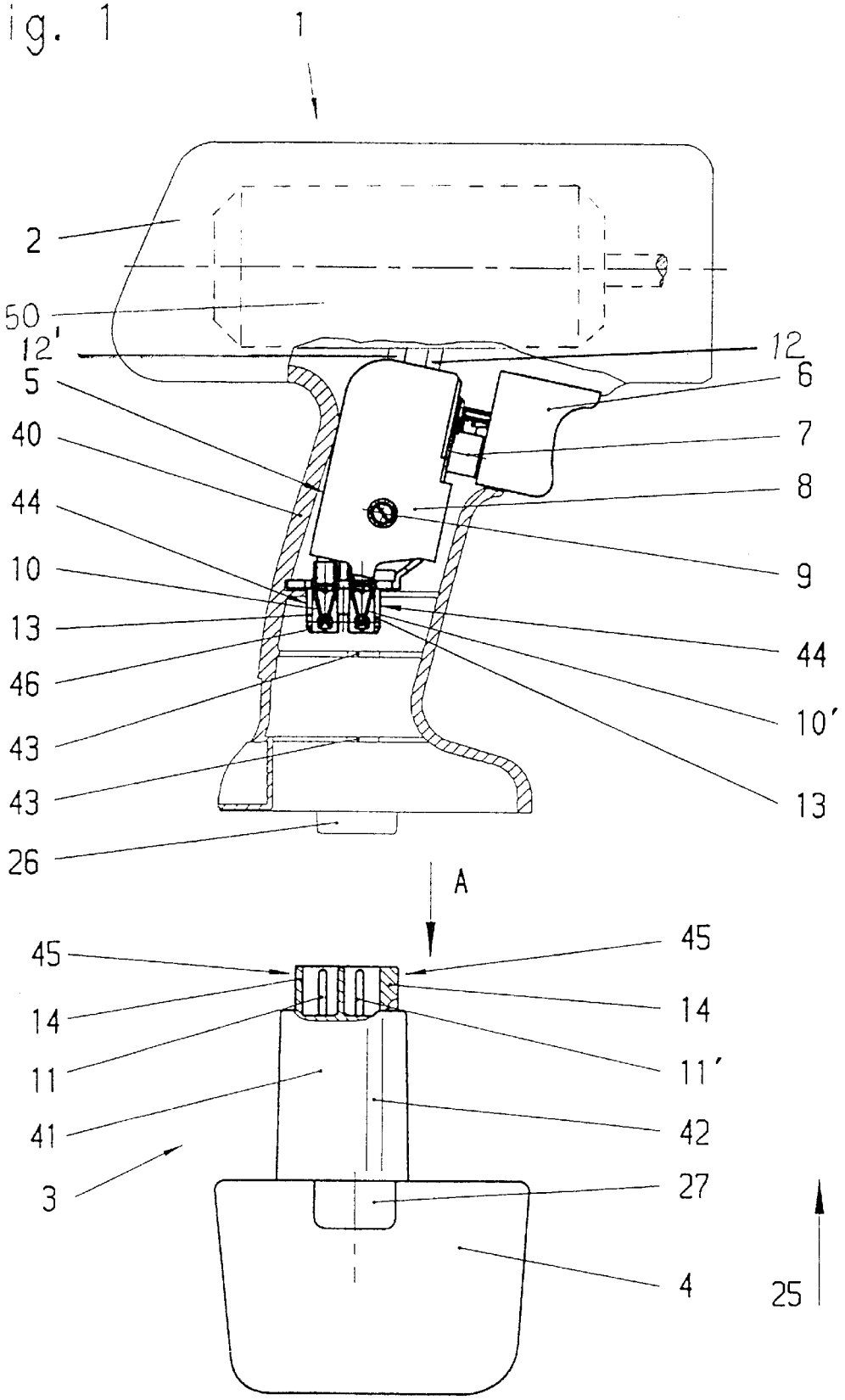
FIG. 1 is a fragmentary, partially sectional side elevational view of a battery-operated electric tool and an associated battery pack.

FIG. 1 shows a housing 2 of a battery-operated electric tool 1 which may be, for example, a battery-operated screwdriver or a battery-operated drill. The region of the handgrip 40 of the battery-operated electric tool 1 is shown in section. A rechargeable battery pack 3 having a housing 4 may be plugged into the tool housing 2 in the direction of the arrow 25 through a bottom opening of the handgrip 40 and may be releasably immobilized in the tool housing 2 by means of latching elements 26, 27. The battery pack 3 serves as an energy source for operating a DC electric motor 50 arranged in the tool housing 2. In the handgrip 40 of the tool housing 2 an electric switch 5 is disposed which permits the electric motor 50 to be switched on and off and its speed to be set by means of a manually adjustable trigger 6. Details of such a switch 5 are disclosed, for example, in the earlier-noted U.S. Pat. No. 5,289,047.

Figure 3:
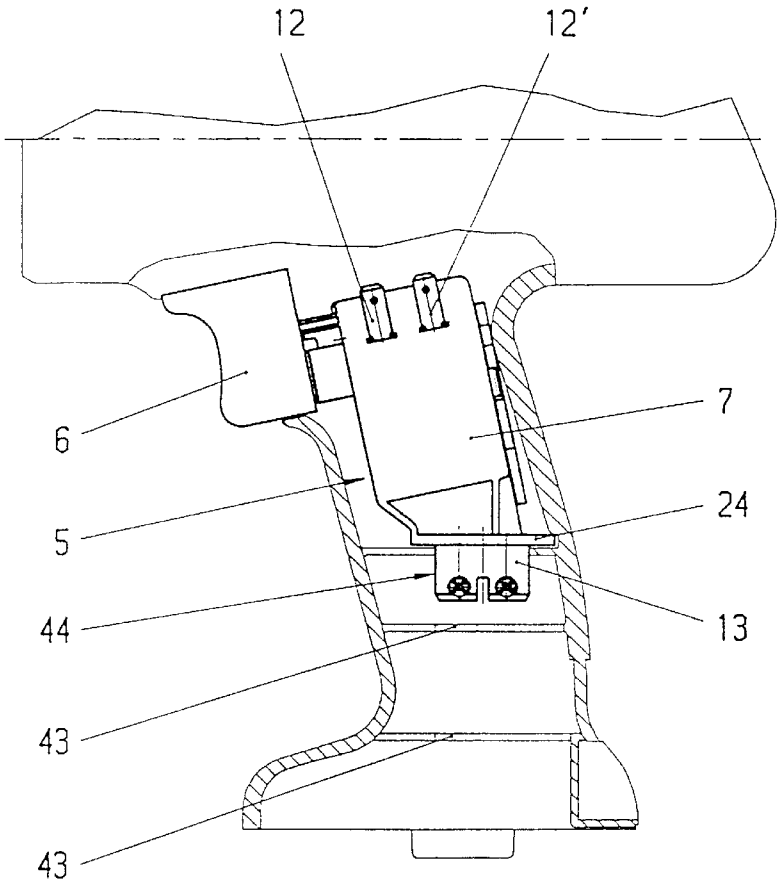
FIG. 3 is a fragmentary, partially sectional side elevational view of the tool, seen in a direction opposite to FIG. 1.

The electric switch 5 has a switch housing 7 on the outside of which a heat sink 8 is fastened by means of a screw 9. Contacts 10, 10' in the form of contact clips are arranged on the switch housing 7 on the side facing the battery pack 3. The battery pack 3 has, at the end of a neck portion 41 situated on the battery pack housing 4, mating contacts 11, 11' in the form of plug-in prongs, so that the mating contacts 11, 11' permit a pluggable electrical connection with the contacts 10, 10' of the switch 5 when the battery pack 3 is being plugged into the tool housing 2. It is to be understood that it is equally feasible to place the contact clips 10, 10' on the battery pack 3 and to provide the tool 1 with the prongs 11, 11'. As shown in FIGS. 1 and 3, further terminals 12, 12' are located on the side of the switch housing 7 oriented away from the battery pack 3. The leads for the electrical connection to the electric motor 50 are fastened to the terminals 12, 12'.

Figure 1A:
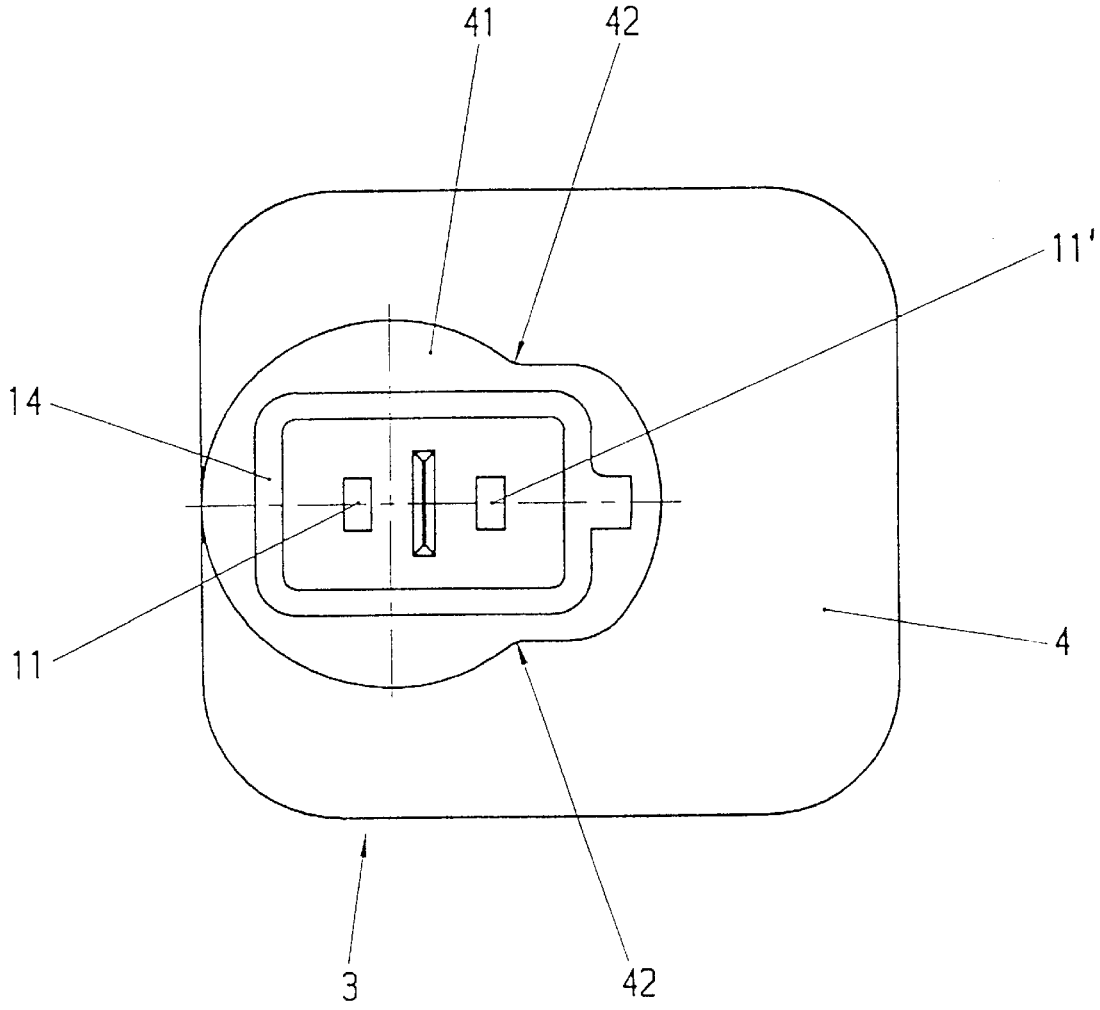
FIG. 1*a* is a top plan view of the battery pack as viewed in the direction of arrow A in FIG 1.

A first or coarse guiding means is provided which is formed of cooperating guide components 42 and 43. The guide component 42 is situated at the neck portion 41 and is formed by a curved part of the neck portion 41 as seen in FIG. 1*a*.

The guide component 43 is arranged in the handgrip 2 of the tool housing 2.

Further, a second or fine guiding means is provided which is formed of cooperating guide components 44 and 45. The guide component 44 is arranged on the switch housing 7 in the region of the contacts 10, 10' and is constituted by a projection (shoulder) 13. The guide component 45 is arranged at the upper end of the neck portion 41 in the region of the mating contacts 11, 11' and is constituted by a projection (shoulder) 14.

For inserting the battery pack 3 into the tool housing 2, the neck portion 41 is introduced into the handgrip 40. During such a motion first the guide components 42 and 43 of the first guiding means cooperate in the handgrip 40 along a first insertion path in such a manner that the battery pack 3 is aligned with the switch housing 7. As a result of such an alignment the contacts 11, 11' at the battery pack 3 are at least approximately in alignment with the contacts 10, 10' of the switch 5. The cooperation of the guide components 42 and 43 of the first guiding means occurs until a first position of the battery pack 3 relative to the tool housing 2 is reached in which the contacts 11, 11' essentially initially touch the contacts 10, 10'. The first insertion path terminates at the first position of the battery pack 3 relative to the tool housing 2, and at the first position a second insertion path begins which extends to a subsequent, second position of the battery pack 3 relative to the tool housing 2 in which the contacts 11, 11' are in final engagement with the contacts 10, 10' for maintaining the operational electric connection. Thus, in the second position the contact prongs (contacts 11, 11') are at least partially surrounded by the contact clips (contacts 10, 10'). During a continued plug-in motion of the battery pack 3 between the first and second positions the guide components 44 and 45 of the second guiding means cooperate with one another along the second insertion path in such a manner that the contacts 11, 11' are guided in their correct position to the contacts 10, 10'. As a result of the preliminary centering by means of the guide components 42, 43 of the first guiding means the contacts 11, 11' reach the contacts 10, 10' in an essentially centered state and are subsequently, as a result of the guidance by the guide components 44, 45 of the second guiding means, centered in a precise manner (fine centering) and inserted into the contacts 10, 10' without tilting. This effectively prevents damage to the contacts 10, 10' or the mating contacts 11, 11' when the battery pack 3 is inserted or removed.

It is noted that by virtue of the disposition of the guide components 42, 43 of the first guiding means and the guide components 44 and 45 of the second guiding means along the entire length of the first and second insertion paths, respectively, a risk of tilting of the battery pack 3 relative to the tool housing 2 during insertion or removal is securely eliminated. In particular, no substantial torques between the contacts 10, 10' and the contacts 11, 11' may appear which could mean the danger of an early destruction thereof. Such substantial torques would normally appear during tilting and would be the result of the long neck portion 41 and the large mass of the battery pack 3. The arrangement according to the invention, on the other hand, ensures a definite lengthening of the service life of the contacts 10, 10', 11 and 11'.

Figure 2:
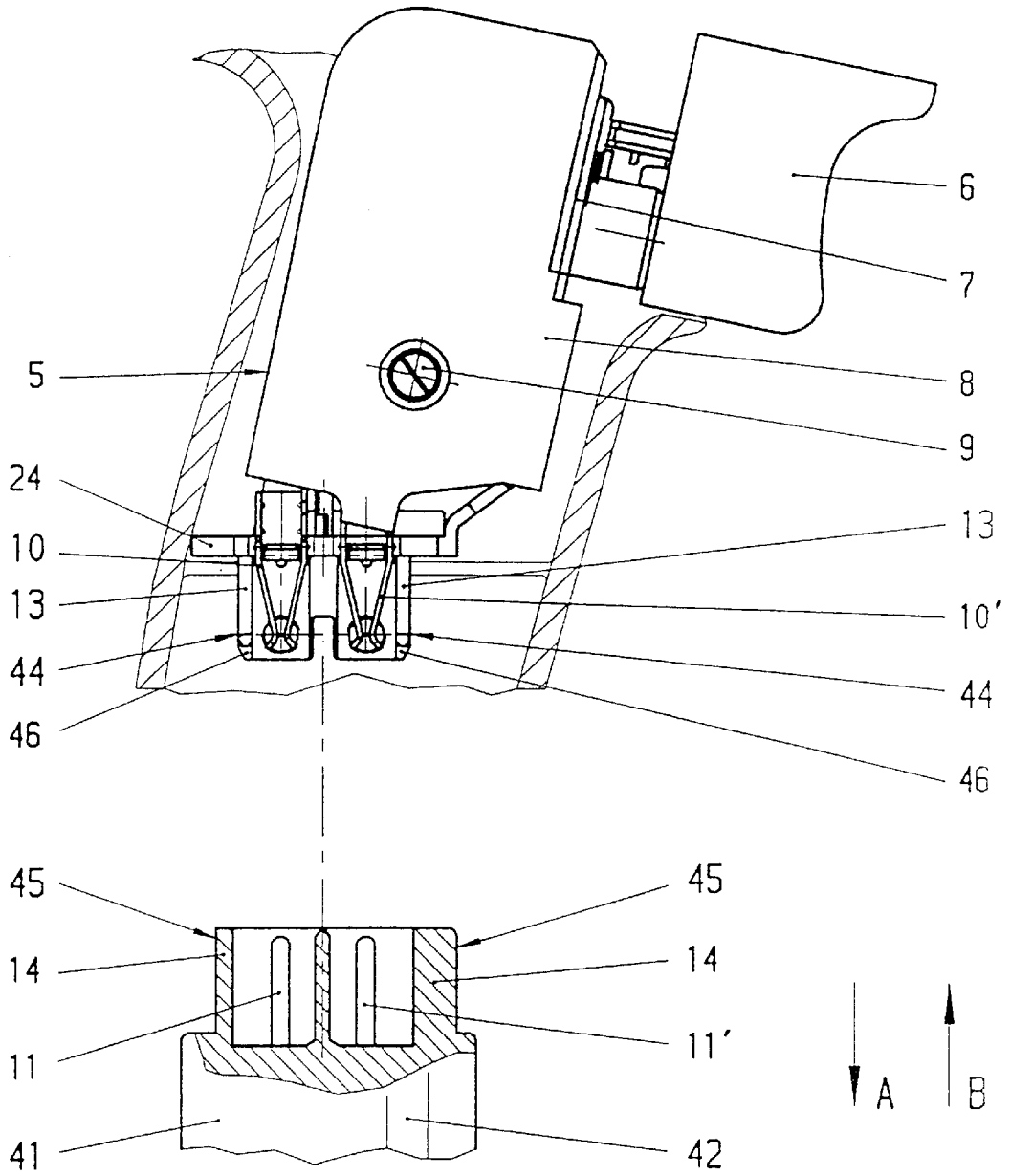
FIG. 2 is an enlarged view of a part of the structure shown in FIG. 1.

For achieving a positionally correct guidance along the entire second insertion path, the guide components 44 and 45 of the second guiding means have mutually corresponding lengths measured at the second insertion path. The lengths are selected such that the guide components 44, 45 of the second guiding means assume a telescoping, slidingly engaging relationship along the second insertion path. As shown in FIG. 2, the guide components 44, 45 of the second guiding means may be respective projections 13 and 14 which are guided on one another along the second insertion path for the positionally correct guidance of the contacts 11, 11' relative to the contacts 10, 10'. The projection 13 at the switch housing 7 has, according to an embodiment, approximately the same length as the contacts 10, 10' and has a planar surface. If desired, the projection 13 can be designed somewhat longer than the contacts 10, 10'. Furthermore, the projection 14 on the battery pack 3 may likewise be at least as long as the mating contacts 11, 11' and may have a planar surface. It is thereby advantageously ensured that when the battery pack 3 is plugged in, the fine centering is effected at the latest when the contacts 10, 10' touch the mating contacts 11, 11'.

Figure 4:
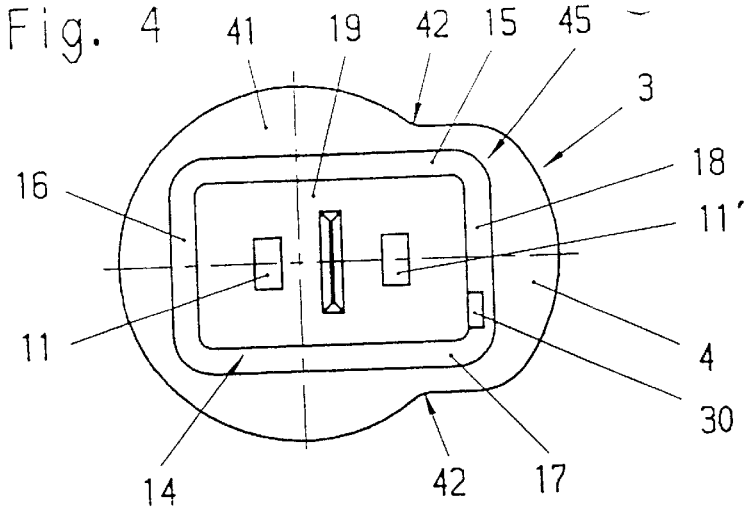
FIG. 4 is a top plan view of a neck portion of the battery pack viewed in the direction of the arrow A of FIG. 2.
Figure 5:
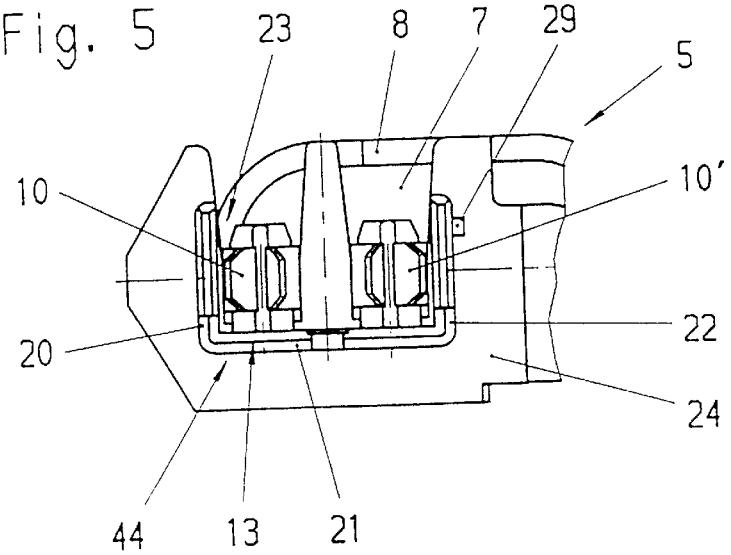
FIG. 5 is a top plan view of the electric switch viewed in the direction of the arrow B of FIG. 2.

In a preferred arrangement according to FIG. 4, the projection 14 on the battery pack 3 consists of a plurality of faces 15, 16, 17, 18, arranged approximately in the shape of a rectangle. Faces 15, 16, 17, 18 thus form the walls of a socket 19 inside which the mating contacts (prongs) 11, 11' are disposed. As shown in FIG. 5, the projection 13 on the switch housing 7 likewise consists of a plurality of faces 20, 21, 22, arranged approximately in a U-shaped configuration. Faces 20, 21, 22 thus form the walls of a guide plug 23 which is open towards one side. The contacts 10, 10' are located inside the guide plug 23 which fits precisely into the socket 19. When the battery pack 3 is plugged in, the socket 19 centers and guides the guide plug 23, and during such an occurrence the mating contacts 11, 11' arrive into an electrical contact with the contacts 10, 10'. For facilitating the introduction of the guide plug 23 into the socket 19, the projection 13 may be provided with a chamfer 46 as shown in FIG. 2. The chamfer 46 at the guide component 44 of the second guiding means arrives, in the first position, into an operative relationship with the guide component 45 of the second guiding means and facilitates the transition from the preliminary centering along the first insertion path to the fine centering along the second insertion path. The plug-in movement of the battery pack 3 may end as the socket 19 abuts a stop surface 24 on the projection 13, whereby a defined second end position is reached and damage to the contacts 10, 10' or mating contacts 11, 11' is securely prevented. It is to be understood, however, that some other surface within the handgrip 40 may serve as the stop surface for determining the second position of the battery pack 3. In such a case the stop surface may also serve for immobilizing and holding the switch 5 within the handgrip 40 of the tool housing 2.

As noted earlier, the guide plug 23 is designed as an approximately U-shaped component partly open at the side.

Figure 6:
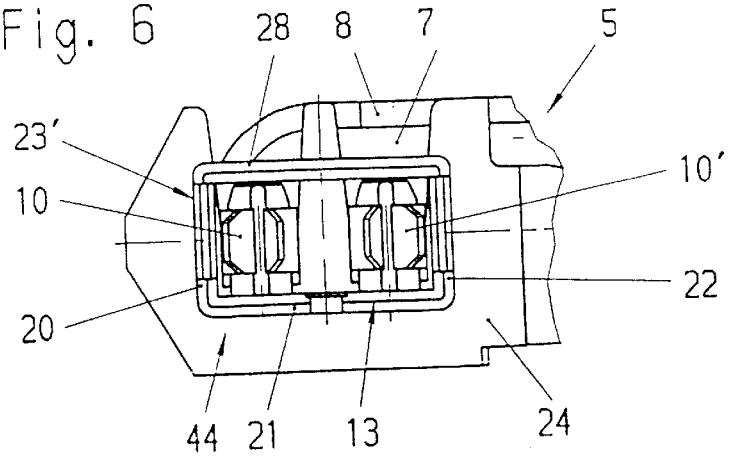
FIG. 6 is a top plan view of the switch as in FIG. 5, illustrating a further embodiment.

According to the variant shown in FIG. 6, the guide plug 23' may be designed as an approximately cuboidal part closed at all sides. For this purpose, the faces 20, 21 and 22 are connected to a further face 28. On the other hand, it is also feasible to design the socket 19 on the battery pack 3 as a partly open part.

Since the electric motor 50 is a DC motor, it is necessary to prevent polarity reversal when the battery pack 3 is plugged in. This is ensured by coding means for the poles constituted by the contacts 10, 10' and mating contacts 11, 11'. The coding means are provided on the projections 13 and 14 and may be slot-and-key joints, dovetail guides or the like. By way of example, in FIG. 5 a key 29 can be seen which is arranged on the projection 13 and extends into a corresponding slot 30, shown in FIG. 4, on the projection 14 when the battery pack 3 is plugged in. The key 29 on the projection 13 interacts with the slot 30 on the projection 14 in such a way as to ensure that the battery pack 3 is inserted in the correct orientation.

The housing 7 of the switch 5 consists of plastic and may be made with an injection-molding process. The projection 13 and the stop surface 24 may be integrally formed from the same material when making the switch housing 7. In such a case it is expedient to form the projection 13 and the stop surface 24 integrally on the switch housing 7 in the same injection-molding process.

The invention is not limited to the described and illustrated exemplary embodiments. Thus, the invention can also be used for electric switches for garden appliances, household appliances or the like. It is to be understood that the electric load in the appliance need not be an electric motor. Thus, such an electric switch can also be used in a battery-operated lamp or the like.

It will be understood that the above description of the present invention is susceptible to various modifications, changes and adaptations, and the same are intended to be comprehended within the meaning and range of equivalents of the appended claims.

What is claimed is:

1. An electric appliance unit comprising an appliance and a plug-in battery pack insertable into and removable from the appliance;

said appliance including
- an appliance housing;
- an electric load disposed in said appliance housing;
- an electric switch disposed in said appliance housing for selectively supplying electric energy to said electric load from said battery pack; said electric switch including first electric contacts; and
- a switch housing disposed in said appliance housing and accommodating said electric switch and said first electric contacts;

said battery pack including
- a battery pack housing; and
- second electric contacts for engaging said first electric contacts of said electric switch; said battery pack having consecutive first and second positions upon introduction thereof into said appliance housing; in said first position said first and second electric contacts initially touch one another and in said second position said first and second electric contacts are in a final operative engagement;

first guiding means for guiding and preliminarily centering said battery pack relative to said switch housing upon introduction of said battery pack into said appliance housing along a first insertion path extending to said first position to effect an at least coarse alignment of said first and second electric contacts with one another upon reaching said first position; said first guiding means including
- a first guide component carried by said battery pack; and
- a second guide component carried by said appliance housing; said second guide component cooperating with said first guide component along said first insertion path during introduction of said battery pack into said appliance housing; and a second guiding means for guiding and fine centering said battery pack relative to said switch housing upon introduction of said battery pack into said appliance housing along a second insertion path extending from said first position to said second position to effect a precise alignment of said first and second electric contacts with one another during motion of said battery pack along said second insertion path; said second guiding means including
- a third guide component carried by said battery pack; and
- a fourth guide component carried by said switch housing adjacent said second electric contacts; said fourth guide component cooperating with said third guide component along said second insertion path during introduction of said battery pack into said appliance housing.

2. The electric appliance unit as defined claim 1, wherein cooperating said first and second electric contacts are clips and prongs and further wherein in said second position said prongs are at least partially surrounded by respective said clips.

3. The electric appliance unit as defined claim 1, wherein said appliance housing comprises a hollow handgrip accommodating said switch housing; further wherein said battery pack has a neck portion attached to said battery pack housing and introducible into said handgrip.

4. The electric appliance unit as defined claim 3, wherein said first guide component is disposed on and along said neck portion and said second guide component is disposed within said handgrip; and further wherein said third guide component is disposed on and projects from a free end of said neck portion adjacent said second electric contacts and said fourth guide component is carried by said switch housing adjacent said first electric contacts.

5. The electric appliance unit as defined claim 4, wherein lengths of said third and fourth guide components are dimensioned along said second insertion path such that said third and fourth guide components are in a slidingly engaging, telescoping relationship with one another during motion along said second insertion path.

6. The electric appliance unit as defined claim 5, further comprising a chamfer provided on said fourth guide component; said chamfer assuming an interengaging position with said third guide component in said first position of said battery pack.

7. The electric appliance unit as defined in claim 1, wherein one of said third and fourth guide components of said second guiding means is an inner telescoping member constituting a plug and one of said third and fourth guide components of said second guiding means is an outer telescoping member constituting a socket; said third and fourth guide components at least partially surrounding said first and second electric contacts, respectively.

8. The electric appliance unit as defined in claim 7, wherein said third and fourth guide components of said second guiding means are composed of planar walls.

9. The electric appliance unit as defined in claim 8, wherein one of said third and fourth guide components of said second guiding means is cuboidal.

10. The electric appliance unit as defined in claim 8, wherein the planar walls of one of the guide components of said second guiding means are three in number and are arranged in a U-shaped configuration.

11. The electric appliance unit as defined in claim 1, further comprising cooperating coding means carried by said third and fourth guide components of said second guiding means for providing for a correct polarity orientation of said first and second electric contacts during insertion of said battery pack into said appliance housing.

12. The electric appliance unit as defined in claim 11, wherein said coding means comprises a slot-and-key joint.

13. The electric appliance unit as defined in claim 1, further comprising a stop surface for abutting one of said third and fourth guide components of said second guiding means to determine said second position of said battery pack in said appliance housing.

14. The electric appliance unit as defined in claim 13, wherein said switch housing and said stop surface form an integral, one-piece plastic component.

15. The electric appliance unit as defined in claim 1, wherein said switch housing and said fourth guide component of said second guiding means form an integral, one-piece plastic component.

* * * * *